United States Patent [19]

Seiler et al.

[11] Patent Number: 5,041,770

[45] Date of Patent: Aug. 20, 1991

[54] APPARATUS FOR ADJUSTING A COMPUTER WORK STATION TO INDIVIDUAL NEEDS

[76] Inventors: Michael A. Seiler; Donald K. Seiler, both of 308 Pleasant St., Van Meter, Iowa 50261

[21] Appl. No.: 437,100

[22] Filed: Nov. 16, 1989

[51] Int. Cl.[5] ..... A47B 37/00; A47B 21/02

[52] U.S. Cl. ..... 318/265; 318/266; 318/468; 108/7; 248/918; 248/919

[58] Field of Search ..... 318/264, 265, 266, 282, 318/466, 467, 468; 248/398, 639, 652, 657, 660, 664, 676, 917, 918, 919, 920, 921, 922, 923; 108/5, 6, 7, 8, 9, 10, 106, 137, 138; 312/208

[56] References Cited

U.S. PATENT DOCUMENTS

| | | | |
|---|---|---|---|
| 4,365,561 | 12/1982 | Tellier et al. | 248/918 X |
| 4,428,631 | 1/1984 | Cope et al. | 248/918 X |
| 4,515,086 | 5/1985 | Kwiecinski et al. | 248/918 X |
| 4,567,835 | 2/1986 | Reese et al. | 248/918 X |
| 4,632,349 | 12/1986 | Anstey | 248/918 X |
| 4,725,106 | 2/1988 | Shields et al. | 108/7 X |
| 4,735,467 | 4/1988 | Wolters | 248/918 X |
| 4,779,922 | 10/1988 | Cooper | 248/918 X |
| 4,805,538 | 2/1989 | Fisher et al. | 108/7 |
| 4,852,500 | 8/1989 | Ryburg et al. | 248/919 X |

*Primary Examiner*—Bentsu Ro

[57] ABSTRACT

An apparatus for adjusting a computer work station to individual needs including a frame having a keyboard support attached thereto. A vertical adjustment mechanism operatively attached to the frame permits the keyboard support to be adjusted vertically up or down. Also, a pivotal adjustment mechanism is operably attached to the frame and to the keyboard support for permitting the keyboard support to be adjustably pivoted about a substantially horizontal axis. A monitor support is provided and has a horizontal adjustment mechanism operably attached to the frame for selectively moving a monitor support toward or away from the keyboard support and the monitor support also can be adjusted vertically by a separate vertical adjustment mechanism. The adjusting mechanisms for the keyboard support and the monitor support are electrically controlled by the computer user. An adjustable wrist support and an adjustable foot support are also provided.

27 Claims, 5 Drawing Sheets

APPARATUS FOR ADJUSTING A COMPUTER WORK STATION TO INDIVIDUAL NEEDS

TECHNICAL FIELD

The present invention relates generally to an apparatus for adjusting a computer work station to individual needs, and more particularly to an apparatus for controlling the position of a computer keyboard and a computer monitor.

BACKGROUND ART

A computer work station is often merely a desk where the keyboard is in one position and at one level and may be moved around on the desk to other positions but not to other heights or the like. Similarly, a computer monitor normally rests on a desk and the height of the monitor cannot be changed. This causes the individual user to adapt to the position of the keyboard and monitor rather than allowing the user to adjust it to the user's individual needs.

Ergonomic principles dictate that a computer work station should be adaptable to the needs of the individual user in order to maximize the efficiency of each individual user, rather than force each user to adapt to a particular computer work station arrangement.

One of the problems associated with a computer work station which cannot be adjusted to individual needs is that the repetitive motion caused by continuously having the arms, fingers and hands in one position causes carpal tunnel syndrome. A similar problem can be associated with always holding the head and neck in the same position while viewing the computer monitor. Carpal tunnel syndrome is a painful condition which often requires surgery to ameliorate its effects. Furthermore, having the worker comfortable allows the individual worker to be more efficient and have less unproductive time. Since the causes of carpal tunnel syndrome are well-known, employers would be well advised to use equipment as it becomes available which will reduce the repetitiveness of certain routine tasks. The problem has been that products of this nature have not heretofore been commercially available.

DISCLOSURE OF THE INVENTION

The present invention relates to an apparatus for adjusting a computer work station to individual needs including a frame having a keyboard support attached thereto. A vertical adjustment mechanism operatively attached to the frame permits the keyboard support to be adjusted vertically up or down. Also, a pivotal adjustment mechanism is operably attached to the frame and to the keyboard support for permitting the keyboard support to be adjustably pivoted about a substantially horizontal axis. A monitor support is provided and has a horizontal adjustment mechanism operably attached to the frame for selectively moving a monitor support toward or away from the keyboard support and the monitor support also can be adjusted vertically by a separate vertical adjustment mechanism. The adjusting mechanisms for the keyboard support and the monitor support are electrically controlled by the computer user. An adjustable wrist support and an adjustable foot support are also provided.

An object of the present invention is to provide an improved apparatus for adjusting a computer work station to individual needs.

Another object of the present invention is to provide an apparatus for controlling the position of the computer keyboard and a computer monitor.

A further object of the present invention is to provide an apparatus of the aforementioned type which is quickly and easily adjusted by the user to prevent the tasks being performed from being repetitive to the extent that they would cause carpal tunnel syndrome.

Other objects, advantages and novel features of the present invention will become apparent from the following detailed description of the invention when considered in conjunction with the accompanying drawings.

BEST MODE FOR CARRYING OUT THE INVENTION

Figure 1:
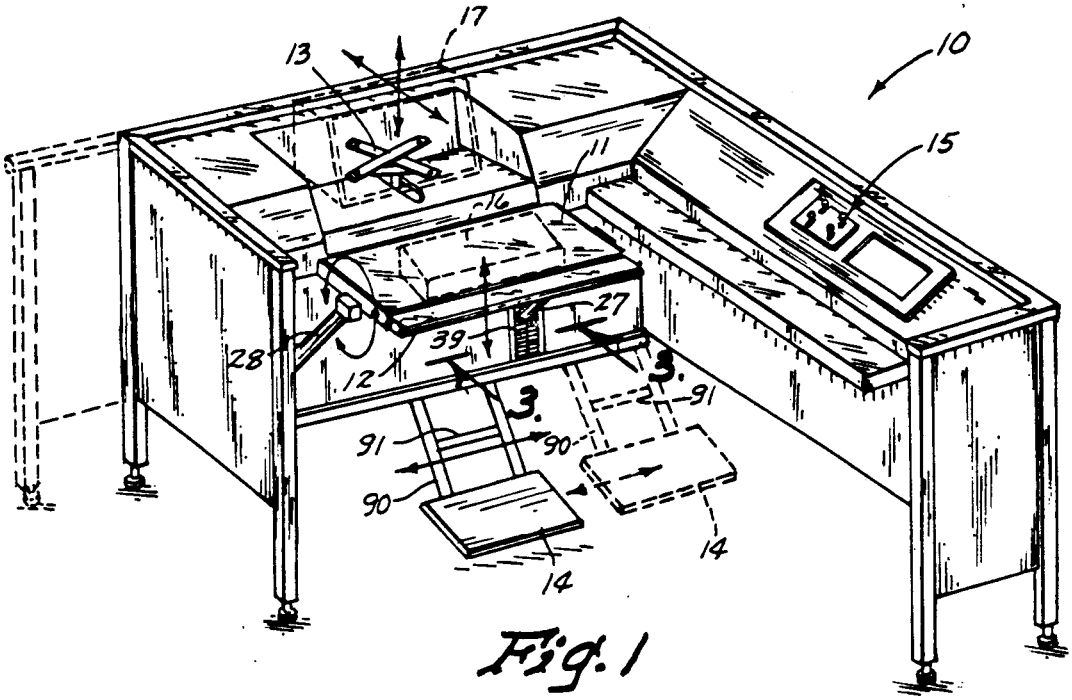
FIG. 1 is a perspective view of a computer work station having a preferred embodiment of the present invention incorporated therein.
Figure 2:
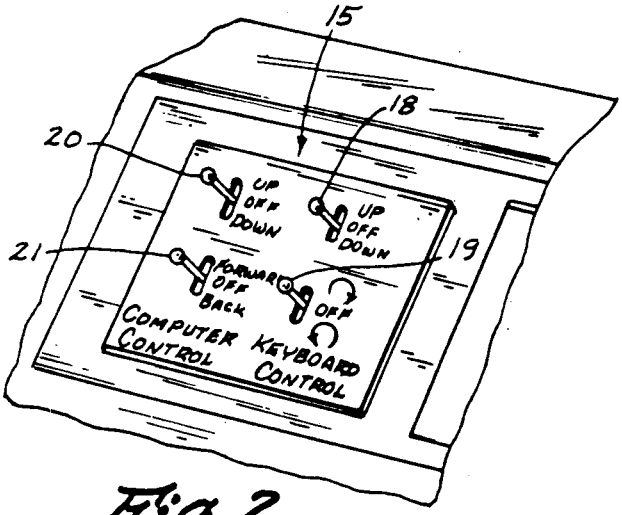
FIG. 2 is an enlarged partial perspective view of a control panel for the work station of FIG. 1.

Referring now to the drawings wherein like reference numerals designate identical or corresponding parts throughout the several views, FIG. 1 shows a computer station (10) having a preferred embodiment of the present invention incorporated therein. The computer work station (10) shown in FIG. 1 has a keyboard support (11), a wrist support (12), a monitor support (13) and a foot support (14). A control panel (15) is provided as shown in FIGS. 1 and 2 for electrically and automatically controlling the position of the keyboard support (11) and the monitor support (13). The keyboard itself is indicated in dashed lines by numeral (16), and the monitor is indicated in dashed lines in FIG. 1 by the numeral (17).

Referring to FIG. 2, it is noted that by moving the lever (18) up, the keyboard support (11) will move up and moving the lever (18) down, the keyboard support (11) will move down automatically. Similarly, by moving the lever (19) up, the keyboard support (11) will rotate in a clockwise direction, and moving the lever (19) down from the neutral position shown the keyboard support (11) will rotate in a counterclockwise direction.

Similarly, by moving the lever (20) from the neutral position shown to the up position, the monitor support (13) will be raised vertically upwardly. Moving the lever (20) from the neutral position shown to the down position will, conversely, move the monitor support (13) down. Similarly, by moving the control lever (21) from the neutral position shown in FIG. 2 upwardly to the forward position will cause the monitor support (13) to move toward the keyboard support (11) and, conversely, moving the lever (21) downwardly to the back position, will cause the monitor support (13) to move back away from the keyboard support (11).

Figure 5:
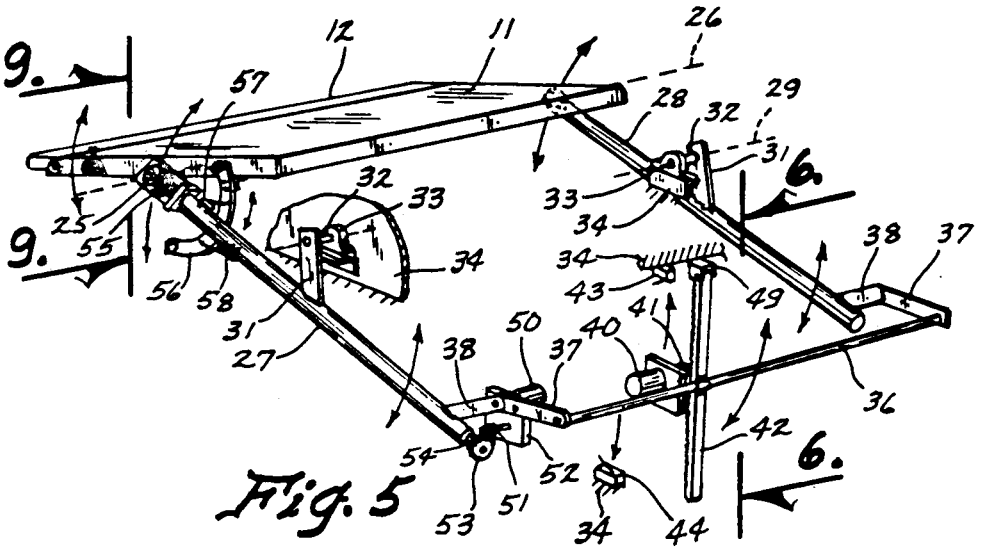
FIG. 5 is an enlarged perspective view of the mechanisms used to control the adjustment of the keyboard support.

Referring now to FIG. 5, it is noted that the keyboard support (11) has a bevel gear (25) rigidly attached thereto along a horizontal axis (26). Tubular elongated members (27) and (28) are pivotally attached at the upper end to the keyboard support (11) along the horizontal axis (26) and these elongated members (27) and (28) are also pivotally attached along a horizontal axis (29) by flanges (31) and pivot pins (32) mounted into bearings (33) which are rigidly attached to the frame (34) and ultimately to the desk (10).

Figure 6:
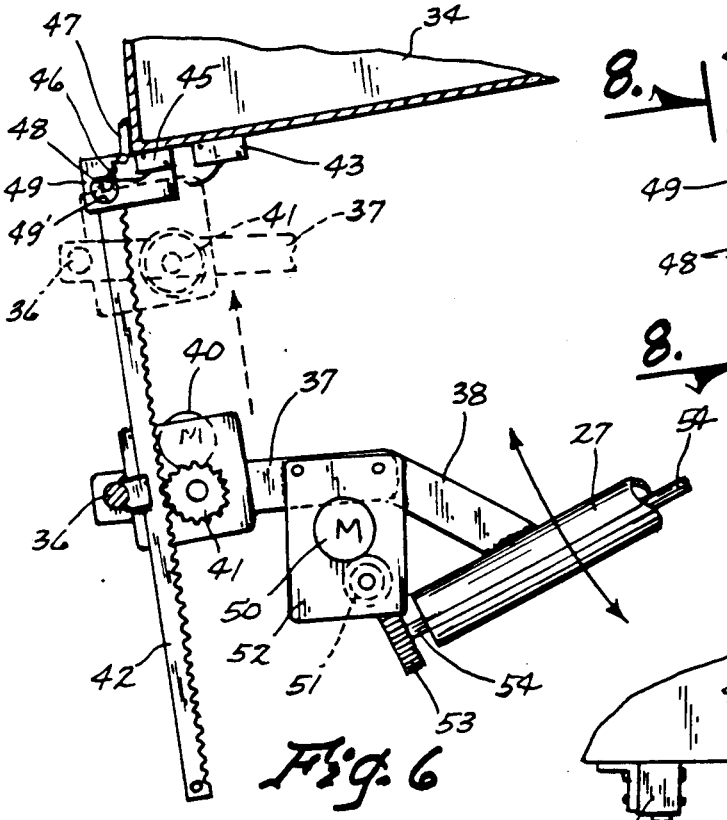
FIG. 6 is an enlarged cross-sectional view taken along line 6—6 of FIG. 5.
Figure 7:
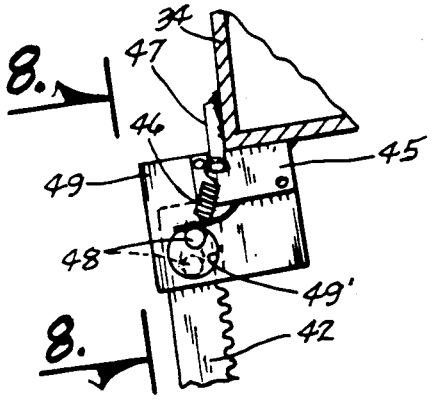
FIG. 7 is an enlarged view of the emergency stop switch which is activated when the keyboard support meets with too much resistance as it is being lowered.

The other end of the elongated tubes (27) and (28) are connected together by a rod (36) and connectors (37) and (38). A reversible electric motor (40) is rigidly connected to the rod (36), and has a gear (41) which has teeth which engage the teeth of a rack (42). This rack (42) is attached to the frame (34) as shown in FIGS. 5, 6 and 7. A normally closed upper switch (43) is attached to the frame (34) and a normally closed lower switch (44) is also attached to the frame (34). A normally open emergency switch (45), shown in FIGS. 6 and 7, will be discussed below.

Figure 9:
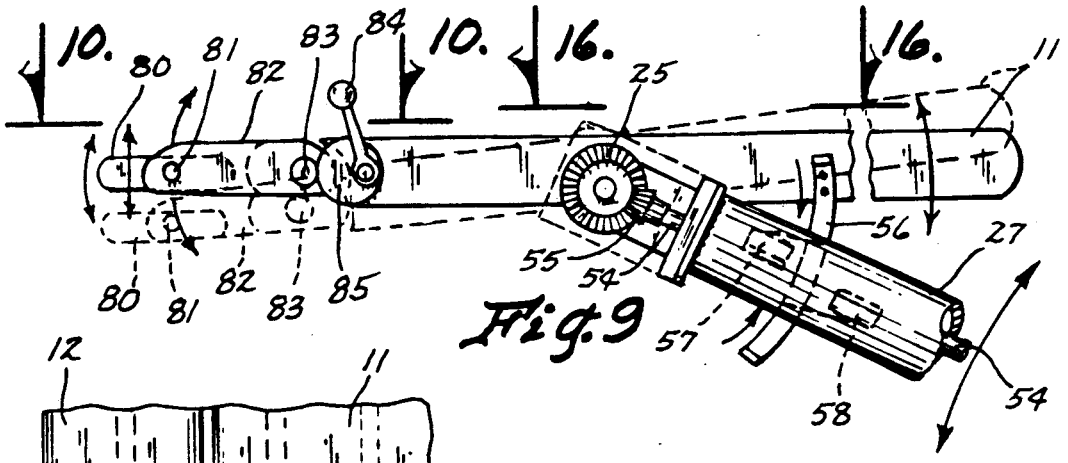
FIG. 9 is an enlarged partial view taken along line 9—9 of FIG. 5 and showing portions of the keyboard support and the wrist support.

Another reversible electric motor (50) is attached to the elongated member (27) by members (37) and (38), and the motor (50) operates a gear (51) through a gear box (52). The gear (51) engages and turns the gear (53) which is rigidly attached to a rod (54). This rod (54) has a bevel gear (55) at the top end thereof which is held in engagement with the bevel gear (25) as shown in FIGS. 5 and 9.

To move the computer support (11) up, the switch (18) is moved accordingly which will cause the reversible motor (40) to turn in the appropriate direction to cause the gear (41) to move along the rack (42) and cause the rear end of the elongated members (27) and (28) to move down, thereby causing the keyboard support (11) to move up. To move the keyboard support (11) down, the switch (18) is moved accordingly to the position shown in FIG. 15 whereby the reversible motor (40) causes rotation of the gear (41) in an opposite direction to cause the gear (41) to move up on the rack (42) thereby causing the other end of the members (27) and (28) and thereby keyboard support (11) to move down as the elongated members (27) and (28) pivot about longitudinal axis (29).

As the keyboard support (11) is raised, the rod (36) will eventually come in contact with the upper limit switch (44) which is a normally closed switch but which will be opened thereby shutting off the circuit when the rod (36) contacts the normally closed switch (44). This will prevent the keyboard support (11) from being raised beyond a predetermined amount. Similarly, when the keyboard support (11) is being lowered, if it is lowered far enough it will eventually cause the rod (36) to come in contact with the downward limit switch (43) which is also a normally closed switch. When the rod (36) contacts the normally closed switch (43), it will open the switch (43), thereby shutting off the power to the motor (40) and preventing the computer keyboard support (11) from being lowered beyond the predetermined distance.

Figure 8:
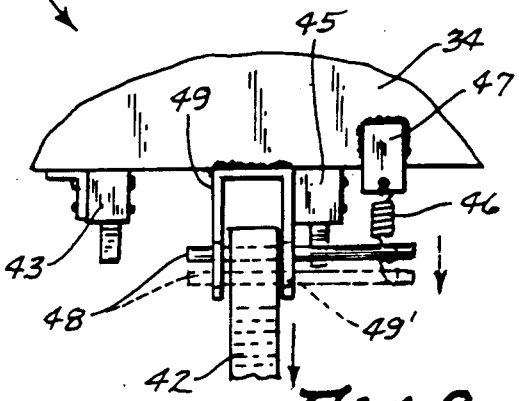
FIG. 8 is a view taken along line 8—8 of FIG. 7.
Figure 15:
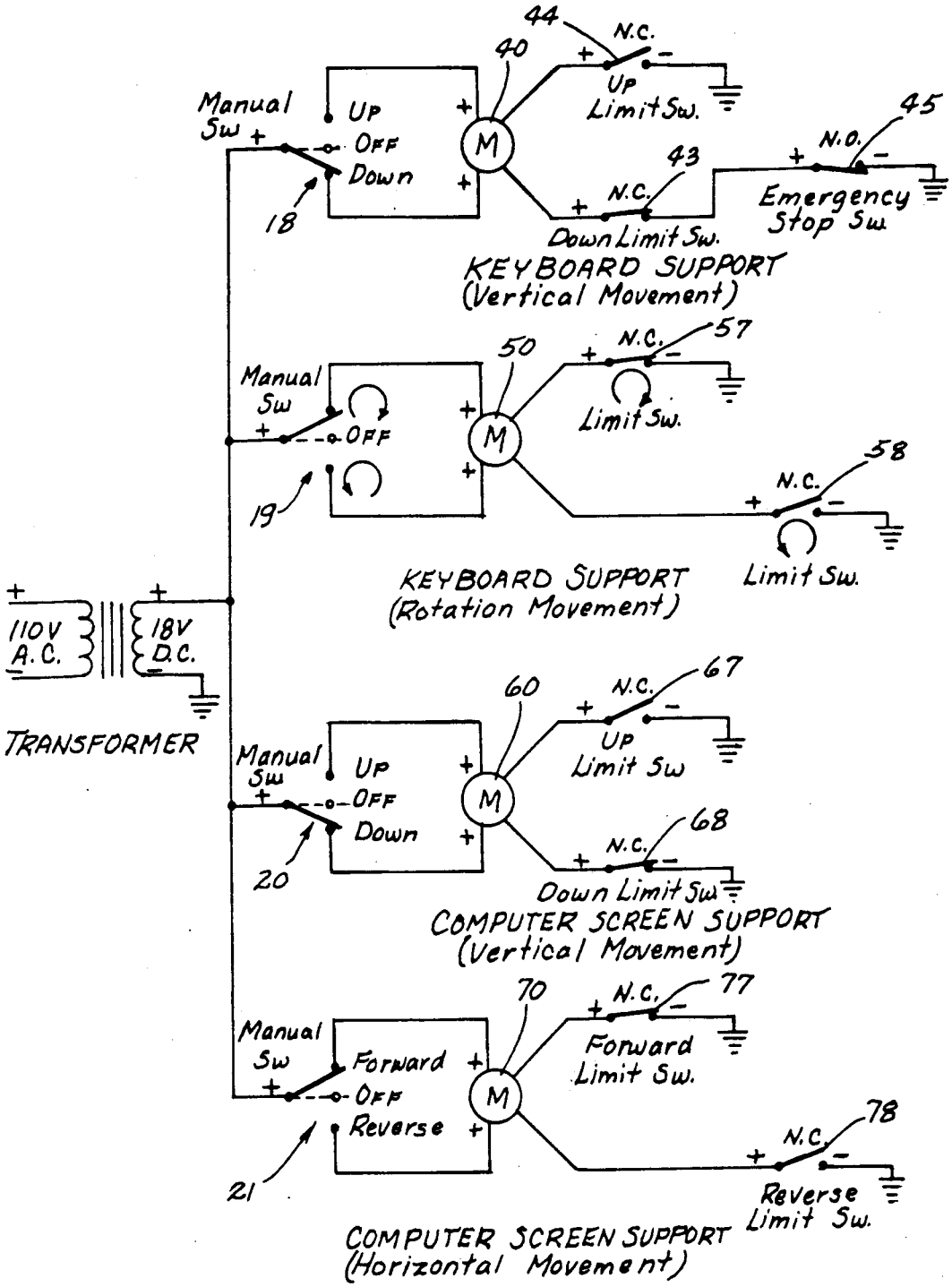
FIG. 15 is a schematic view in simplified form of the electrical control for the four reversible electric motors which control the positions of the keyboard support and the monitor support.

If during the process of lowering the computer keyboard platform (11) by moving the lever (18) to the position shown in FIG. 15, the computer keyboard platform (11) comes into contact with the top of a chair or encounters any other resistance such as the leg of a user thereof, the emergency stop switch (45) will cause the electricity to the motor (40) to be shut off as a safety measure. Referring to FIGS. 6 and 7, it is noted that the normally opened switch (45) is held into a closed position by a tension spring (46) which is connected at one end to the frame (34) by a tab (47) and at the other end to a pin (48) in opening (49') of member (49). If a chair or some other resistance contacts the underside of computer keyboard support (11) as it is being moved downwardly by the motor (40), then continued movement of the motor (40) and gear (41) will pull downwardly on the pin (48) and tension spring (46) until the pin (48) is pulled down to the position shown in dashed lines in FIG. 7. When the pin (48) is moved to the position shown in dashed lines in FIG. 7, the normally open switch (45), which is normally held closed by the tension spring (46), will now be allowed to move to its normally open position thereby shutting off the power to the motor (40) and thereby preventing too much downward pressure on the computer keyboard platform (11). It is to be understood that the pin (48) extends through and is permanently affixed to the top of the rack (42) so that the rack (42) is held upwardly to the position shown in solid lines in FIG. 8 until and unless downward resistance is encountered by the computer keyboard platform (11), in which case the pin (48) moves to the position shown in dashed lines in FIGS. 7 and 8, thereby permitting the normally open emergency stop switch (45) to shut off the power to the motor (40).

When it is desired to tilt the keyboard support (11) in a clockwise direction, the switch (19) is moved to the position shown in FIG. 15 which will cause the reversible motor (50) to turn in one direction, thereby causing the gears (51), (53) and (55) to rotate accordingly. This will rotate the bevel gear (25) which is rigidly affixed to the computer keyboard support (11) which will thereby cause the keyboard support (11) to pivot about the pivotable axis (23).

Figure 16:
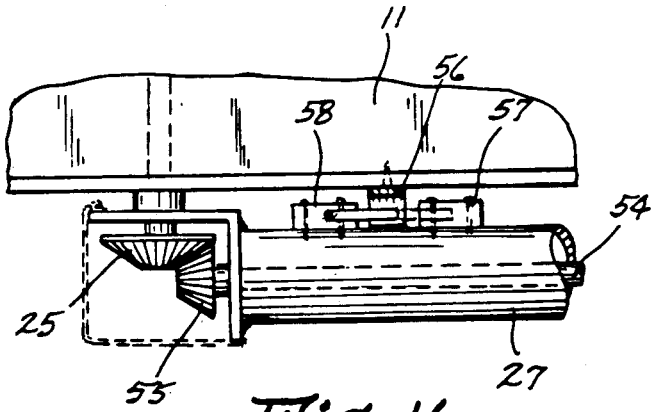
FIG. 16 is a cross-sectional view taken along line 16—16 of FIG. 9.

To pivot the keyboard support (11) in an opposite or counterclockwise direction, the manual switch (19) is moved from the position shown in FIG. 15 to its opposite position, which will reverse the direction of the reversible motor (50) thereby causing the gears (51), (53) and (55) to rotate opposite to the position previously rotating and thereby causing the bevel gear (25)

and thereby the keyboard support (11) to pivot in the opposite direction as well. If the keyboard support (11) is moved far enough into the counterclockwise direction, stop (56), attached to keyboard support (11), will contact normally closed limit switch (57) (FIGS. 15 and 16) thereby shutting off the circuit to the motor (50). If the computer keyboard (11) is moved in the counterclockwise direction by the switch (19) to such an extent that stop (56) contacts normally closed switch (58) attached to elongated member (27) as shown in FIG. 17, the circuit is opened to shut off the motor (50). Alternatively, one or more mercury switches (not shown) can replace switches (57) and (58) to act as limit switches for turning off motor (50) when the keyboard support (11) pivots too much one way or the other. If mercury switches are used, stop (56) will not be needed.

Figure 10:
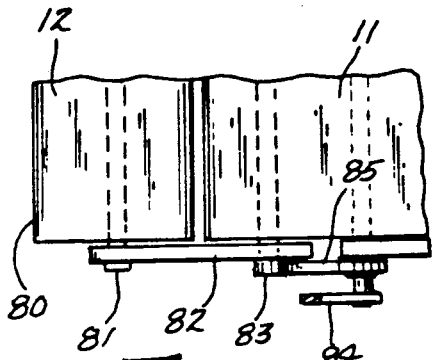
FIG. 10 is an enlarged partial view taken along line 10—10 of FIG. 9.

Referring now to FIGS. 9 and 10, it is noted that a wrist support member (80) is pivotally attached by a pin (81) to brackets (82) which are in turn pivotally attached by pins (83) to the keyboard support (11). The pins (81) are tensioned very tightly and can alternatively be a rod passing entirely through the wrist support (80) so that the wrist support (80) can be pivoted about the axis of the pin or shaft (81) and it will generally stay in that position until manually moved to another rotational position thereof.

The wrist support (80) can also be pivoted about the pin or rod (83) by first releasing the threaded lever (84), which will loosen the washer-like member (85) to reduce or eliminate the frictional engagement of the washer-like member (85) against the brackets (82). Once that is done, the wrist support (80) can be pivoted about the axis of pin or rod (83) and then, by moving the lever (84) which will threadably tighten the washer (85) against the brackets (82), the brackets (82) and thereby the wrist support (80) will be held in whatever position is desired.

Figure 11:
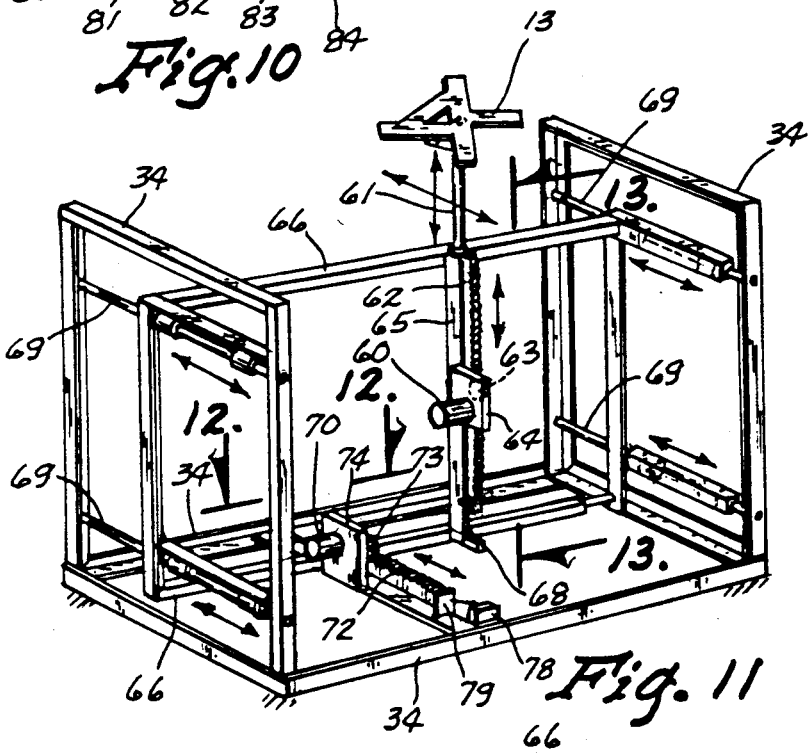
FIG. 11 is a perspective view showing the mechanisms utilized to adjust the monitor support up and down and back and forth.

Referring now to FIG. 11, it is noted that the computer monitor support (13) is disposed on a shaft (61) which is connected to a rack (62) having teeth thereon. Reversible electric motor (60) rotates a gear (63) through gear box (64) and this electric motor (60) and gear box (64) are attached to a member (65) which is rigidly attached to a subframe (66). An upper limit switch (67) and lower limit switch (68) are provided so that when the switch (20) is actuated to the down position as shown in FIG. 15, the monitor support (13), shaft (61) and rack (62) will move downwardly until the bottom of the rack (62) contacts the normally closed down limit switch (68), which will open the circuit and shut off the motor (60). Similarly, if the switch (20) is activated to reverse the direction of the motor (60) to cause the rack (62) to move up, it will do so until the top of the rack (62) contacts the normally closed upper limit switch (67), at which time the normally closed limit switch (67) will open and shut off the power to the reversible motor (60).

Figure 12:
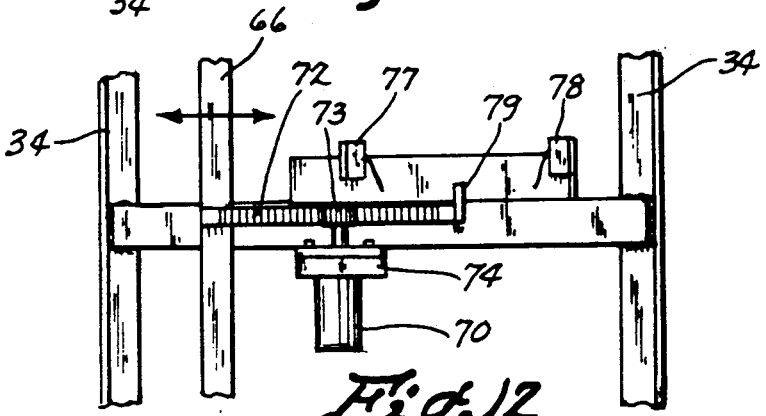
FIG. 12 is an enlarged view taken along line 12—12 of FIG. 11.

The subframe (66) is slidably mounted on rods (69) to the main frame (34). A geared rack (72) is rigidly attached to the subframe (66) as is shown in FIG. 12. Consequently, the rack (72) moves with the subframe (66). The reversible motor (70), when activated by the manual switch (21) in a forward direction, will cause rotation of the gear box (74) and gears (73) to cause the rack (72), subframe (66) and consequently the computer monitor support (13) to move forwardly to whatever position is desired. If the computer support (13) is moved forwardly to an extent that the stop (79) comes into contact with the normally closed forward limit switch (77), the normally closed forward limit switch (77) will open, shutting off the power to the motor (70). Conversely, if the manual switch (21) is thrown to the reverse position, thereby reversing the position of the motor (70), the rack (72), subframe (66), the monitor support (13) will move rearwardly, away from the keyboard support (11) until the stop (79) shown in FIG. 12 contacts the normally closed reverse limit switch (78), at which time the normally closed reverse limit switch (78) will open, thereby shutting off the power to the motor (70) to prevent further rearward motion of the monitor support (13).

Figure 13:
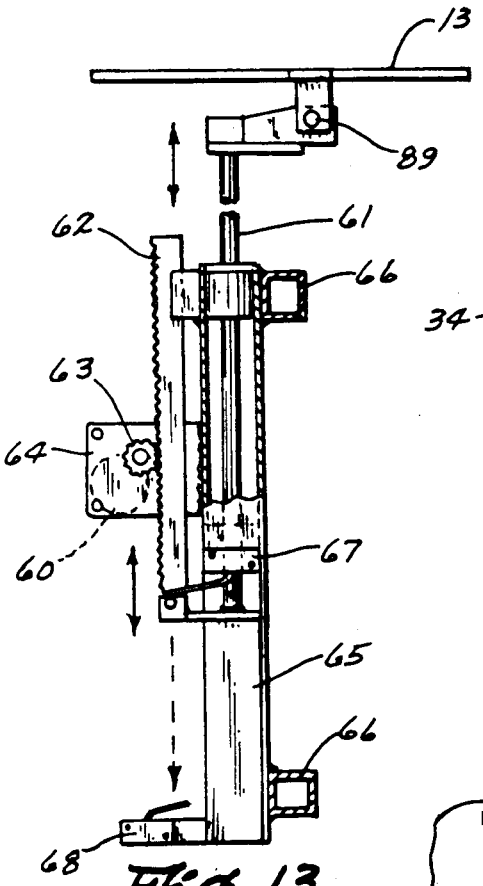
FIG. 13 is an enlarged partial cross-sectional view taken along line 13—13 of FIG. 11.

Referring to FIG. 13, it will be noted that the computer monitor support (13) can be pivoted along the pivotal axis of pin (89) and that it can also pivot about the shaft (61) to provide even more adjustments to the computer work station (10).

Figure 14:
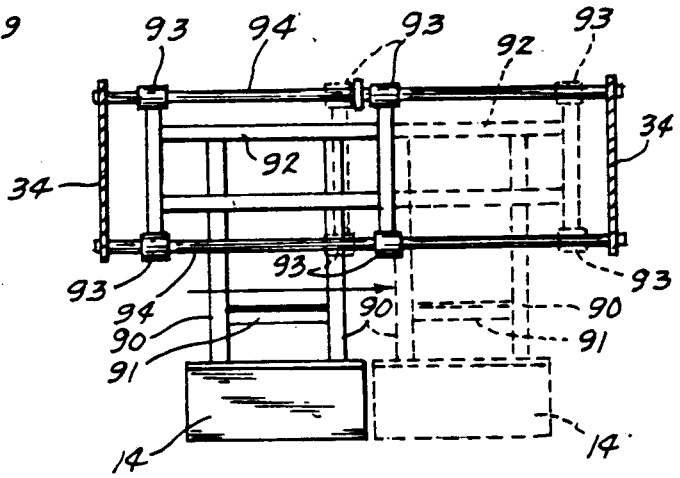
FIG. 14 is a cross-sectional view of the foot support mechanism showing in solid lines one position thereof, and in dashed lines another position of the foot rest mechanism.

Referring to FIG. 14, it is noted that the foot rest (14) has a grid work of members (91) and (92) which can be in many alternate configurations, for example by using only half of the connectors shown, and the foot rest (14) is slidably mounted on bearing members (93) which slide on rods (94) which are rigidly attached to the frame (34). Consequently, the foot rest (14) can be slid along to any position on the rods (94), for example to and between the position shown in solid lines and in dashed lines in FIG. 14.

Figure 3:
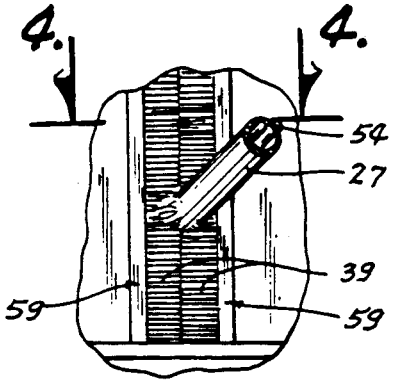
FIG. 3 is an enlarged perspective view taken along 3—3 of FIG. 1.
Figure 4:
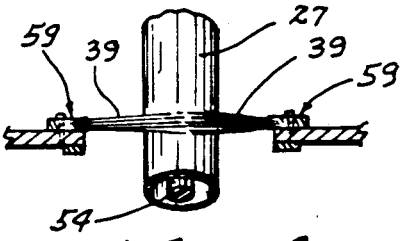
FIG. 4 is a cross-sectional view taken along line 4—4 of FIG. 3.

FIGS. 3 and 4 show how bristles (39), attached to the computer work station (10) by assemblies (59) tend to seal off the opening through which elongated members (27) extend.

Accordingly, it will be appreciated that the preferred embodiment disclosed herein does indeed accomplish the aforementioned objects. Obviously, many modifications and variations of the present invention are possible in light of the above teachings. It is therefore to be understood that, within the scope of the appended claims, the invention may be practiced otherwise than as specifically described.

We claim:

1. Apparatus for controlling the position of a computer keyboard and a computer monitor comprising:

a frame; keyboard support means for supporting a computer keyboard;

first vertical adjustment means operatively attached to said frame for selectively moving said keyboard support means vertically up or down; wherein said first vertical adjustment means comprises:

a first elongated member operably attached at one end thereof to one side of said keyboard support means and operably pivotally attached to said frame along a substantially horizontal axis;

a second elongated member operably attached at one end thereof to the other side of said keyboard support means and operably pivotally attached to said frame along said substantially horizontal axis; and first electrically operated means operably attached to said frame and operably attached to the other end of at least one of said first and second elongated members for selectively pivoting said horizontal axis whereby said keyboard support means can be adjusted vertically up or down;

pivotal adjustment means operatively attached to said frame and to said keyboard support means for adjustably pivoting said keyboard support means about a second substantially horizontal axis;

a monitor support means for supporting a computer monitor;

horizontal adjustment means operatively attached to said frame for selectively moving said monitor support means toward or away from said keyboard support means; and second vertical adjustment means for selectively moving said monitor support means up or down.

2. The apparatus of claim 1 wherein said first electrically operated means comprises:

a rack having teeth thereon operably attached to said frame;

a gear engaging the teeth of said rack; and a reversible electric motor means for selectively rotating said gear clockwise or counterclockwise.

3. The apparatus of claim 1 wherein said first elongated member has an opening therethrough and said pivotal adjustment means comprises:

a shaft rotatably disposed in the opening in the first elongated member;

a first bevel gear attached to one end of said shaft;

a second bevel gear attached to said keyboard support means and being in engagement with said first bevel gear; and means for selectively rotating said shaft in a clockwise or a counterclockwise direction for pivoting said keyboard support means about said second substantially horizontal axis.

4. The apparatus of claim 3 wherein said rotating means comprises a reversible electric motor.

5. The apparatus of claim 3 including:

wrist support means attached to a rear edge of said keyboard support means for supporting the wrist of a user of a keyboard disposed thereon.

6. The apparatus of claim 5 including pivot means for pivotally attaching said wrist support means to said keyboard support means along an axis substantially parallel to said second substantially horizontal axis whereby said wrist support means can be adjusted up or down from said keyboard support means.

7. The apparatus of claim 6 including locking means for holding said wrist support means in any desired pivotal position thereof with respect to said keyboard support means.

8. The apparatus of claim 6 including means for rotatably attaching said wrist support means to said pivot means about another axis for permitting the front of the wrist support means to be higher than the rear thereof or the rear thereof to be higher than the front thereof.

9. The apparatus of claim 1 including means for shutting off said first electrically operated means when said keyboard support means contacts something that resists its downward movement while said first electrically operated means is actuated to move said keyboard support means down.

10. The apparatus of claim 1 including upper limit switch means for shutting off said first electrically operated means when said keyboard support means reaches a predetermined upper position.

11. The apparatus of claim 1 including lower limit switch means for shutting off said first electrically operated means when said keyboard support means reaches a predetermined lower position.

12. The apparatus of claim 1 wherein said second vertical adjustment means comprises:

a rack having teeth disposed thereon operatively attached to said monitor support means;

a gear operably attached to said frame and engaging the teeth of said rack; and second electrically operated means for rotating said gear in a clockwise or a counterclockwise direction for moving said rack and thereby said monitor support means up or down.

13. The apparatus of claim 12 including an upper limit switch means for shutting off said second electrically operated means when said monitor support means reaches a predetermined upper position.

14. The apparatus of claim 12 including a lower limit switch means for shutting off said second electrically operated means when said monitor support means reaches a predetermined lower position.

15. The apparatus of claim 12 wherein said second electrically operated means comprises a reversible electric motor.

16. The apparatus of claim 12 wherein said horizontal adjustment means comprises:

a subframe;

means for attaching said subframe to said frame for permitting said subframe to move horizontally in a forward and rear direction;

said second electrically operated means being rigidly attached to said subframe and said rack being movably attached for vertical movement with respect to said subframe;

a second rack rigidly attached to said subframe in a substantially horizontal orientation, said second rack having teeth;

a second gear engaging the teeth on said second rack; and third electrically operated means operably attached to said frame for selectively rotating said second gear in a clockwise or counterclockwise direction for moving said subframe and thereby said monitor support means in a forward or reverse direction.

17. The apparatus of claim 16 including a forward limit switch means for shutting off said third electrically operated means when said monitor support means reaches a predetermined forward position.

18. The apparatus of claim 17 including a rear limit switch means for shutting off said third electrically operated means when said monitor support means reached a predetermined rearward position.

19. The apparatus of claim 18 wherein said third electrically operated means comprises a reversible electric motor.

20. The apparatus of claim 1 wherein said horizontal adjustment means comprises:

a rack having teeth disposed thereon operatively attached to said monitor support means;

a gear operably attached to said frame and engaging the teeth of said rack; and third electrically operated means for rotating said gear in a clockwise or a counterclockwise direction for moving said rack and thereby said monitor support means horizontally back and forth.

21. The apparatus of claim 20 including a forward limit switch means for shutting off said third electrically operated means when said monitor support means reaches a predetermined forward position.

22. The apparatus of claim 20 including a rear limit switch means for shutting off said third electrically operated means when said monitor support means reaches a predetermined rearward position.

23. The apparatus of claim 20 wherein said third electrically operated means comprises a reversible electric motor.

24. The apparatus of claim 1 including:

foot rest means operably attached to said frame for providing an elevated platform for a user's feet; and means for permitting said foot rest means to be adjusted laterally in a horizontal direction.

25. The apparatus of claim 1 including:

wrist support means attached to a rear edge of said keyboard support means for supporting the wrist of a user of a keyboard disposed thereon.

26. The apparatus of claim 25 including locking means for holding said wrist support means in any desired pivotal position thereof with respect to said keyboard support means.

27. The apparatus of claim 25 including means for rotatably attaching said wrist support means to a pivoty means about another axis for permitting the front of the wrist support means to be higher than the rear thereof or the rear thereof to be higher than the front thereof.

* * * * *